US011230140B2

(12) United States Patent
van Os et al.

(10) Patent No.: US 11,230,140 B2
(45) Date of Patent: Jan. 25, 2022

(54) METHOD AND SYSTEM FOR MOUNTING A SHEET

(71) Applicant: Xpozer B.V., The Hague (NL)

(72) Inventors: Clemens Leonard van Os, The Hague (NL); Ivan Suwandi van der Veld, The Hague (NL)

(73) Assignee: Xpozer B.V., The Hague (NL)

( * ) Notice: Subject to any disclaimer, the term of this patent is extended or adjusted under 35 U.S.C. 154(b) by 0 days.

(21) Appl. No.: 16/960,029

(22) PCT Filed: Dec. 28, 2018

(86) PCT No.: PCT/NL2018/050891
§ 371 (c)(1),
(2) Date: Jul. 3, 2020

(87) PCT Pub. No.: WO2019/135675
PCT Pub. Date: Jul. 11, 2019

(65) Prior Publication Data

US 2021/0070098 A1 Mar. 11, 2021

(30) Foreign Application Priority Data

Jan. 5, 2018 (NL) ..... 2020236

(51) Int. Cl.
*G09F 7/18* (2006.01)
*B44D 3/18* (2006.01)
*G09F 15/00* (2006.01)

(52) U.S. Cl.
CPC ..... *B44D 3/185* (2013.01); *G09F 7/18* (2013.01); *G09F 15/0025* (2013.01); *G09F 2007/1886* (2013.01)

(58) Field of Classification Search
CPC ..... G09F 15/0025; G09F 15/0018; G09F 2007/1886; G09F 2015/0093; B44D 3/185; B44D 3/18
See application file for complete search history.

(56) References Cited

U.S. PATENT DOCUMENTS 4,507,887 A * 4/1985 Seely ..... G09F 7/22 116/63 P
5,090,143 A * 2/1992 Schier ..... G09F 1/12 40/603
5,979,847 A 11/1999 Williams et al.
9,183,768 B2 * 11/2015 Maguire ..... G09F 7/22
(Continued)

FOREIGN PATENT DOCUMENTS

DE 4018015 A1 * 12/1991 ..... A47G 1/08
EP 2331347 A1 6/2011
WO 2004084160 A1 9/2004

*Primary Examiner* — Cassandra Davis
(74) *Attorney, Agent, or Firm* — N.V. Nederlandsch Octrooibureau; Catherine A. Shultz; Katelyn J. Bernier

(57) ABSTRACT

A method for mounting a sheet delimited by edges substantially in a plane, the method involving providing a plurality of corner segments on the back of the sheet at least in the vicinity of corners between two edges; and connecting the corner segments by fitting at least one mounting member in between the corner segments, attaching each corner segment to a connection member, which is flexible and glued to the back of the sheet, and subsequently forcing the corner segments apart outwardly substantially in the plane.

14 Claims, 5 Drawing Sheets

(56) References Cited

U.S. PATENT DOCUMENTS

| | | | | |
|---|---|---|---|---|
| 9,266,384 | B2 * | 2/2016 | Van Os | B44D 3/185 |
| 2012/0312948 | A1 * | 12/2012 | Maguire | G09F 15/0062 248/309.1 |

* cited by examiner

METHOD AND SYSTEM FOR MOUNTING A SHEET

TECHNICAL FIELD

The invention relates to a method for mounting a sheet in a planar configuration. Furthermore, the invention relates to a mounting system for mounting a sheet in a planar configuration. The invention also relates to a connection member and to an assembly comprising a mounting system and a sheet.

BACKGROUND ART

Patent document EP 2 331 347 (Van Os and Van der Veld) describes a method and system for mounting a canvas or sheet substantially in one plane. The invention provides a method for mounting a sheet delimited by edges essentially in one plane, comprising attaching a plurality of engagement members on the back of the sheet in the vicinity of corners between two edges and fitting at least one mounting member in between. By providing engagement members and mounting member(s) on the back, it is ensured in this case that the entire sheet remains visible, and no parts of the image are obstructed. The method furthermore comprises attaching the corner segments to the back of the sheet, and the subsequent forcing outward of the corner segments.

SUMMARY OF INVENTION

Using the method of EP 2 331 347, the outward force towards the corners may establish a torque, which may result in bending of the sheet.

According to an aspect of the invention, there is provided a method for mounting a sheet delimited by edges substantially in a plane, the method comprising providing a plurality of corner segments on the back of the sheet at least in the vicinity of corners between two edges; and connecting the corner segments by fitting at least one mounting member in between the corner segments; attaching each corner segment to a connection member, which is flexible and glued to the back of the sheet; and subsequently forcing the corner segments apart outwardly substantially in the plane.

The mounting member may be adjustable in length and tensioned by means of a spring. Using this method, the tensile forces in the outward direction are transferred via the corner segments and to the connection members. The tensile forces which may originate from the mounting member in the outward direction are distributed to the corner segment and then to the connection member, which is itself glued, stuck or adhered to the back of the sheet. The outward force is transferred to the connection member very close to the plane, at a distance from the plane equal to the thickness of the planar portion of the connection member. As a result, no force can exist in a direction perpendicular to the plane. In this way a flat appearance of the corner area is established.

The invention applies to canvasses or sheets of any shape that can fit in the plane. Using this method, a printed image, such as a poster, a photograph, a screen or anything comparable, can be mounted in a planar manner, without obstructing part of the image on the front side of the sheet. A skilled person will understand that the term 'sheet' may as well refer to other equivalent terms, such as poster, photograph, screen, canvas, drawing, map, and any equivalences thereof. 'Gluing' may refer to any equivalent manner of permanently attaching without leaving a trace at the front side of the sheet. The corner segment may be made of polycarbonate, polypropylene, acrylonitrile butadiene styrene (ABS) or any other injection molded plastic or metal. In this context, 'substantially' is meant to include deviations that will have the same effect, as can be understood by a person skilled in the art. The connection member may be a sticker or laminate, and is stuck to the plane over a relatively large area, typically more than 10 $cm^2$, in some embodiments more than 25 $cm^2$.

A flexible connection member that is glued to a sheet is convenient when rolling up the sheet, for example for efficient transport or storage. In this way, the connection members may be kept glued to the sheet and do not need to be removed. The connection member may be made of flexible plastic, such as polyethylene terephthalate ("PET"), polycarbonate or polypropylene.

According to an embodiment, providing a plurality of corner segments comprises: providing at least two engagement members, which each comprise two adjacent corner segments and a main segment connecting the two corner segments and extending along a central part of an edge of the sheet, and wherein connecting the corner segments comprises: fitting the at least one mounting member in between the engagement members.

The engagement members may be adjustable in length. Each engagement member may comprise one main segment and two corner segments, which extend from either end of the main segment to the respective corners of the sheet. The main segment and the corner segments may be pivotably connected. As the mounting member may be tensioned, the engagement members may be forced apart, such that the corner segments are forced outwardly in the plane. In this way, a planar configuration of the sheet is established.

According to an embodiment, each corner segment is attached to the connection member using at least one connection region. The connection region may be elongated. If only one elongated connection region is provided, it may be oriented substantially perpendicular to the net outward force. In this context, elongated refers to a longitudinal size which is at least 3 times larger than a transversal size.

According to an embodiment, at least two connection regions are provided which are each elongated and substantially aligned to one of the edges adjacent to the respective corner. The connection regions of one connection member are substantially aligned with an adjacent edge, i.e. making an angle of less than 40 degrees with a respective edge.

According to an embodiment, at each corner, at least two connection regions are substantially perpendicular to each other. Perpendicular connection regions promote efficient transfer of force to the corner segments, especially in case of square or rectangular canvasses or sheets. It also ensures that the outward force defines an angle of less than 45 degrees with at least one of the connection regions. If the connection regions would be substantially perpendicular to the outward force, the outward force could establish a torque, and bending of the corner around the connection region could happen. Substantially perpendicular connection regions counteract this. In this context, 'substantially' is meant to include deviations to the perpendicular angle that will have a similar effect, as can be understood by a person skilled in the art.

According to an embodiment, the connection regions comprise at least one folded part of the connection member, folded towards the corner segment, out of the plane. The at least one part of the connection member may extend outside the sheet and is foldable in an out-of-plane direction, thus extending out of the image plane towards the back side of the sheet. The folding lines together with the folded parts constitute the connection regions. The corner segment can be placed against the folded parts in a form-fitting manner. When the corner segments are forced apart, the forces are transferred to the folded parts and thus to the connection member. Tensile forces are thus substantially uniformly distributed over a large area close to the corners of the sheet, promoting a flat appearance of the sheet. In an embodiment at least two parts of the connection member are folded in the manner as described herein.

According to an embodiment, at least one folded part of the connection member is attachable to the corner segment. The attachment of the folded parts improves the stability of the construction. This attachment can be permanent or non-permanent. Attachment may happen by means of clamping, gluing, mechanical fixing, melting, fusing, or equivalents thereof.

According to an embodiment, the folded parts each comprise at least one opening which is adapted for attachment to the corner segment.

According to an embodiment, the method further comprises: providing at least one cover member and placing at least one cover member over the openings. The cover member or the corner segment comprises at least one protrusion, wherein each protrusion is adapted to be accommodated inside an opening. The cover member is placed over the openings in order to attach the folded parts to the corner segment. The cover member is fixed to the corner segment, to maintain the folded parts in place and keep the folded parts attached to the assembly that comprises the cover member and the corner segment.

The corner segment may be placed against the folded parts first, and the cover member may be placed against the folded parts and the corner segments afterwards. Alternatively, the cover member may be placed and fixed, either permanently, e.g. glued, or non-permanently, against the outer side folded parts first. Then, the corner segment is placed against the inner side of the folded parts.

According to an embodiment, the cover member comprises at least one protrusion, wherein each protrusion is adapted to be accommodated inside an opening. While bringing the cover member to the corner segment, the folded parts are folded and attached to the cover member by means of the protrusions and the openings. When fixing the cover member to the corner segment, the folded parts are provided in between the cover member and the corner segment and maintained in place by means of the protrusions. After fixing the cover member to the corner segment, the folded parts are durably fixed to the cover member and corner segment. In this embodiment, the corner segment may comprise at least one cavity, wherein each cavity is adapted to at least partially accommodate a protrusion therein. The cavities provide an additional means to ensure fixture of the folded parts to the corner segment and cover member.

According to an embodiment, the corner segment comprises at least one protrusion, wherein each protrusion is adapted to be accommodated inside an opening. The folded parts are folded around the corner segment and the protrusions are accommodated inside the openings. In this way the folded parts are fixed to the corner segment. One or more cover members may be placed over the folded parts and fixed to the corner segment. While fixing the cover member to the corner segment, the folded parts are attached in between the cover member and the corner segment and maintained in place by means of the protrusions. In this embodiment, the cover member may comprise at least one cavity, wherein each cavity is adapted to at least partially accommodate a protrusion therein. The cavities provide an additional means to ensure fixture of the folded parts to the corner segment and cover member.

When the protrusion is accommodated inside the opening, friction forces and/or the exact shape may keep it in place. In this way, the connection member is fixed in movement in the plane, and also in movement out of the plane. There may be a single protrusion and opening, or one at both sides of the corner, or two at both sides of the corner, or any other configuration with at least one protrusion and at least one opening. The cover provides an additional fixture to the connection between the folded parts and the protrusions. The cover member may be pivotably connected to the other part of the corner segment and folded over the folded parts. Alternatively, the cover member may be a separate part. The protrusions are either provided on the cover member, or on the corner segment.

According to an embodiment, the corner segment or the cover member comprises at least one cavity, wherein each cavity is adapted to at least partially accommodate a protrusion therein. The cavities provide an additional fixture to the connection between the folded parts and the protrusions. If the protrusions are provided on the cover member, the cavities are in the corner segment. If the protrusions are provided on the corner segment, the cavities are in the cover member.

According to an aspect of the invention, there is provided a mounting system for mounting a sheet delimited by edges substantially in one plane, comprising: a plurality of engagement members to be attached to the back of the sheet in the vicinity of corners between two edges of the sheet; and at least one mounting member to be fitted between the engagement members. Each engagement member comprises: at least one main segment extending along a central part of the respective edge; and at least two corner segments extending on either side of the main segment up to the corners, which are pivotable in the plane with respect to the main segment while their movability in a direction at right angles to the plane is limited. Each corner segment is connected to a connection member which is flexible and glued to the back of the sheet. The direction at right angles to the plane refers to the direction perpendicular or orthogonal to the plane.

The mounting system has the same advantages as provided by the method described above. Reference to the above-mentioned part of description is made in further describing the present mounting system and its embodiments.

According to an embodiment, each corner segment is attached to the connection member using at least one connection region.

According to an embodiment, at each corner, at least two connection regions are provided which are each elongated and substantially aligned to one of the edges adjacent to the respective corner and which are substantially perpendicular to each other.

According to an embodiment, the at least one connection region comprises at least one folded part of the connection member, folded towards the corner segment, and wherein the at least one folded part of the connection member is attachable to the corner segment.

According to an embodiment, the folded parts each comprise at least one opening, and the corner segment comprises protrusions wherein each protrusion is adapted to be accommodated inside an opening, in order to attach the folded parts to the corner segment.

According to an embodiment, the mounting system further comprises at least one cover member, placed against and/or over the folded parts to maintain the folded parts in place and keep the folded parts attached to the corner segment.

According to an embodiment, the at least one cover member comprises at least one cavity, wherein each cavity is adapted to at least partially accommodate a protrusion therein.

According to an embodiment, each corner segment comprises; a first attachment part which is connected to the main segment; and a second attachment part; wherein the second attachment part is attachable to the respective connection member; wherein the first attachment part is connectable to the second attachment part, possibly with a pivotable connection which can be loosened. The first attachment part is connected to the main segment, possibly in a pivotable manner. The attachment between first and second attachment parts possibly has a U-shaped cross-section, wherein one of the parts can be shifted in between the legs of the 'U'. In this way, the first and second attachment parts cannot move any more in the direction perpendicular to the plane, while movement in a direction in the plane is limited because of the outward force applied from the mounting system towards the sheet, and the inward (tension) force applied from the sheet towards the mounting system. Using a corner segment comprising two different parts allows a user to easily unmount the mounting system without the need to detach the sheet from the connection member, the connection member from the corner segment or the corner segment from the main segment.

According to an aspect of the invention, there is provided a connection member, comprising: a planar portion, adapted to be attached to the back side of a sheet; and at least one folded part, adapted to be attached to a corner segment; and wherein the connection member is adapted to be used in the method as described herein. The connection member may already be folded. It may also be provided with pre-applied folding lines separating the planar portion from the folded part, enabling a user to fold the folded parts when applying the method or using it in a mounting system as described herein.

According to an embodiment, the planar portion comprises an adhesive, to make the connection member attachable to a back side of a sheet. 'Adhesive' may refer to any equivalent manner of permanently attaching without leaving a trace at the front side of the sheet. It may be a multi-layer laminate with an adhesive layer and a cover which needs to be removed prior to sticking it to a back side of a sheet.

According to an aspect of the invention, there is provided an assembly, comprising a mounting system as described herein and a sheet, attached to the mounting system.

BRIEF DESCRIPTION OF DRAWINGS

Embodiments will now be described, by way of example only, with reference to the accompanying schematic drawings in which corresponding reference symbols indicate corresponding parts.

The figures are meant for illustrative purposes only, and do not serve as restriction of the scope or the protection as laid down by the claims.

DESCRIPTION OF EMBODIMENTS

Figure 1:
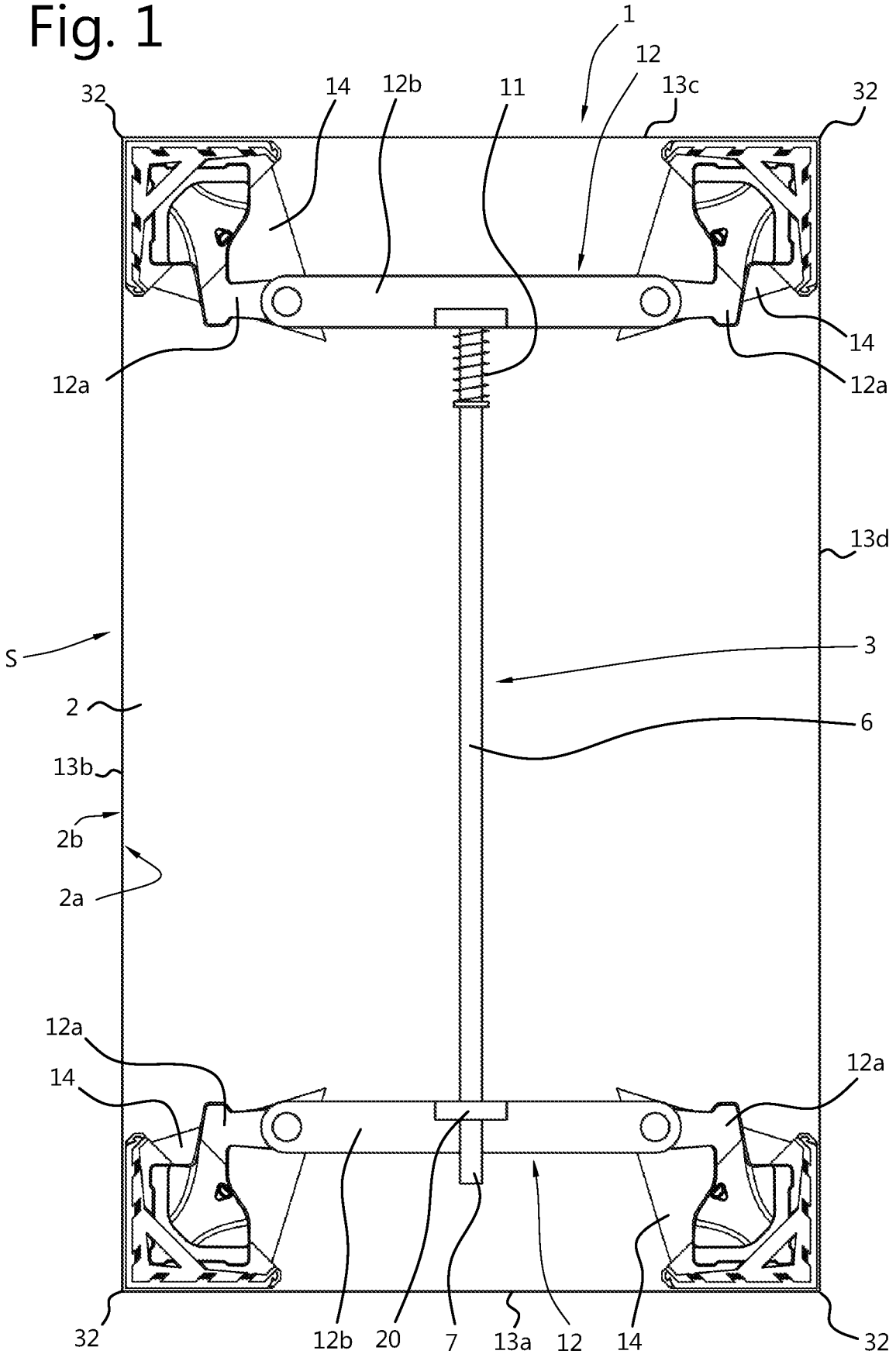
FIG. 1 shows a back side view of a mounting system with sheet according to an embodiment.

FIG. 1 shows a back side view of a mounting system 1 with sheet 2. The sheet 2 is delimited by two long edges 13*b*, 13*d* and two short edges 13*a*, 13*c*. The mounting system 1 comprises two engagement members 12, which can each be attached to the back 2*a* of the sheet 2, virtually out of sight when viewed from the image side 2*b*. To this end, an engagement member 12 has a substantially elongate shape and has movable and length-adjustable components. In addition, the engagement member 12 is designed to engage with the sheet 2 at certain positions. Furthermore, the mounting system 1 comprises one mounting member 3, which is arranged between the engagement members 12. The mounting member 3 serves to keep the engagement members 12 at a virtually attached position with respect to one another, during use of the mounting system 1 when keeping the sheet 2 mounted. Each engagement member 12 extends along substantially the entire length of a respective edge 13*a*, 13*c* of the sheet. In this case, each engagement member 12 only acts on the corners 32 of the sheet 2. The mounting member 3 is also adjustable in length. This is achieved in a simple manner, as the mounting member 3 has a base part 6 and a part 7 which is displaceable therefrom, for example a telescopic part 7. As a result thereof, a mounting member 3 of such a design can be used with canvasses or sheets 2 of different dimensions. In addition, attaching means are present by means of which each mounting member 3 is attached at a set length. These attaching means are formed by a crossing member which has an aperture through which the telescopic part 7 extends in the embodiment shown. The attaching means can alternatively be designed as a simple adjusting screw or other attachment means in other embodiments.

The mounting member 3 is tensioned by means of a spring element 11 which is provided around at least one of the telescopic ends 7 after the telescopic ends 7 have been inserted in apertures 20 in an engagement member 12. The stiffness properties of the engagement members 12 and the mounting member 3 are such that any possible deformation of the entire mounting system 1 can result in only a very small component in a direction perpendicular to the plane S of the sheet compared to the characteristic dimensions of the sheet. For example, a perpendicular deformation in a sheet with dimensions around a metre would be limited to only a few millimetres.

The engagement members 12 comprise two corner segments 12*a* which are connected to the main segment 12*b*. The corner segments 12*a* are each located in the vicinity of a corner 32 of the sheet 2. The corner segments 12*a* each extend from the main segment 12*b* to a corner 32 of the sheet 2. The corner segments 12*a* can move in the plane S, particularly pivot around a pivot point which is the pivotable connection to the main segment. The movement of the corner segments 12*a* in the direction perpendicular to the plane S is limited. The corner segments 12*a* are connected to connection members 14, via folded parts 16 of the connection members 14.

Figure 2:
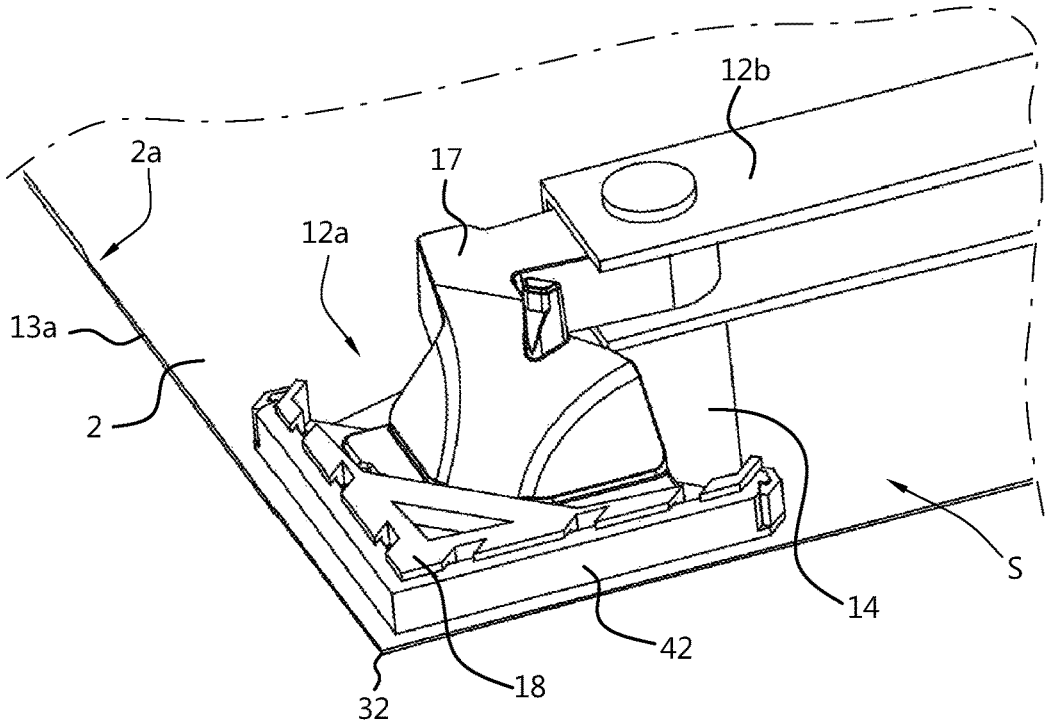
FIG. 2 shows a perspective view of an enlarged part of FIG. 1.

FIG. 2 shows an enlarged part of FIG. 1, depicting a portion of the back side 2*a* of sheet 2 in the vicinity a corner 32. A corner segment 12*a*, at one side connected to a main segment 12*b*, is at the other side connected to a connection member 14. The connection member 14 is a flexible sticker, glued to the back side 2*a* of the sheet 2. Here, the corner segment 12*a* consists of a first attachment part 17 and a second attachment part 18, which are releasably connected. The connection member 14 comprises two folded parts (not shown), folded out of the plane S defined by the sheet 2, towards the back side 2*a* of the sheet 2. The second attachment part 18 is adapted to engage with the folded parts in a form-fitting manner. A cover member 42 is placed over the folded parts and attached to the second attachment part 18 to hold the folded parts in place.

The connection between the second attachment part 18 and the connection member 14 comprises two connection regions (not visible), which are each substantially aligned to one of the edges 13*a*, 13*b* adjacent to the corner 32. When the corner segments 12*a* are forced apart, the forces are transferred to the connection member 14 via the connection regions. Tensile forces are thus substantially uniformly distributed over a large area close to the corners 32 of the sheet 2, promoting a flat appearance of the sheet 2.

Figure 3:
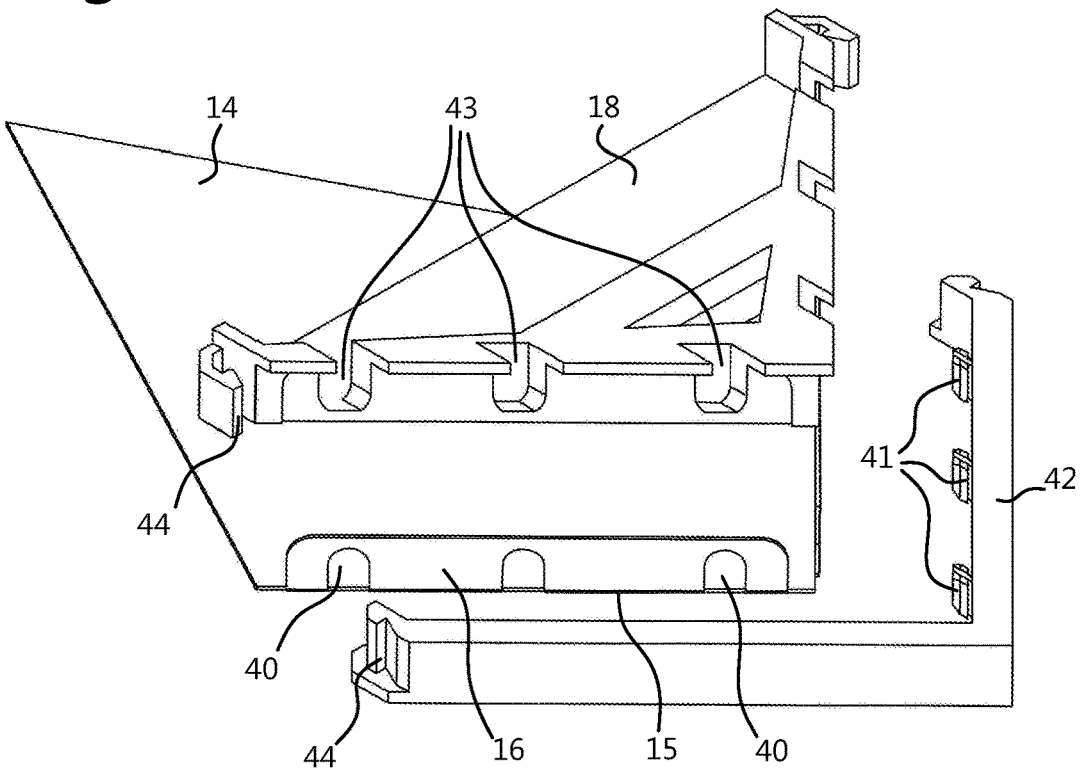
FIG. 3 shows a second attachment part and a connection member according to an embodiment.

FIG. 3 shows an exploded view of the second attachment part 18, the connection member 14 and the cover member 42. The connection member 14 defines folded parts 16 which are folded in a direction substantially perpendicular to the sheet (shown in FIGS. 1 and 2). The folding lines connecting the folded parts 16 with the remainder of the connection member 14 together with the folded parts 16 are connection regions 15. The folded parts 16 each comprise openings 14. The cover member 42 comprises protrusions 41, which can be accommodated inside the openings 40 and in cavities 43 which are provided in the second attachment part 18. The cover member 42 and second attachment part 18 further comprise fixing mechanisms 44, which are adapted to engage with each other to stably connect the cover member 42 and the second attachment part 18. As such, the folded parts 16 are fixed to the second attachment part 18 and thus to the corner segment. When the second attachment part 18 and the cover member stay connected, the connection member 14 cannot be released, other than by tearing material of the connection member 14.

Figure 4:
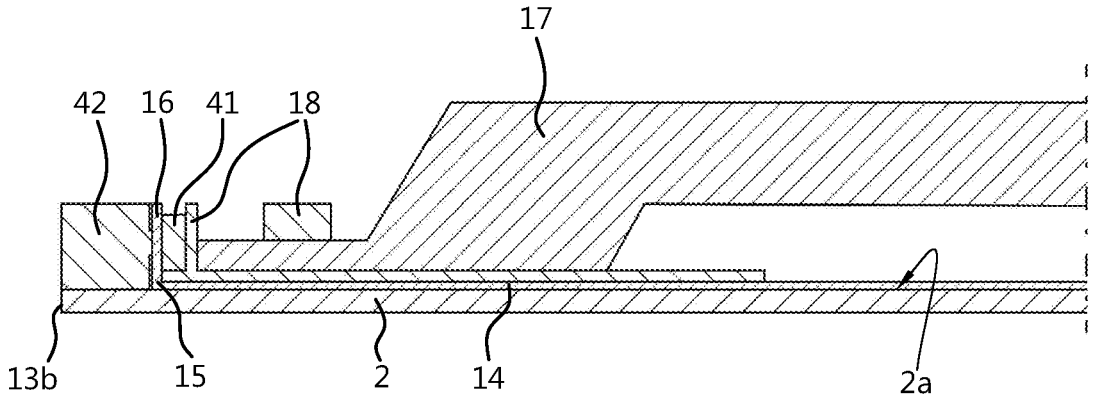
FIG. 4 shows a cross-sectional image of a part of a mounting system with a sheet according to an embodiment.

FIG. 4 schematically shows a cross-section of a part of FIG. 2. The sheet 2 is provided with the connection member 14, glued to the sheet 2 until close to the edge 13*b*. Part of the connection member 14 is folded out of the plane defined by the sheet 2, forming a connection region 15 with a folded part 16. The folded part 16 is in this case folded backwards to the back side 2*a* of the sheet 2, until an angle of 90 degrees between the sheet 2 and the folded part 16. A second attachment part 18 is accommodated against the connection member 14 in a form-fitting manner. The first attachment part 17 is connected to the second attachment part 18. A cover member 42 with a protrusion 41 is placed over the folded parts 16 while the protrusion 41 is accommodated in an opening in the folded part 16.

Figure 5:
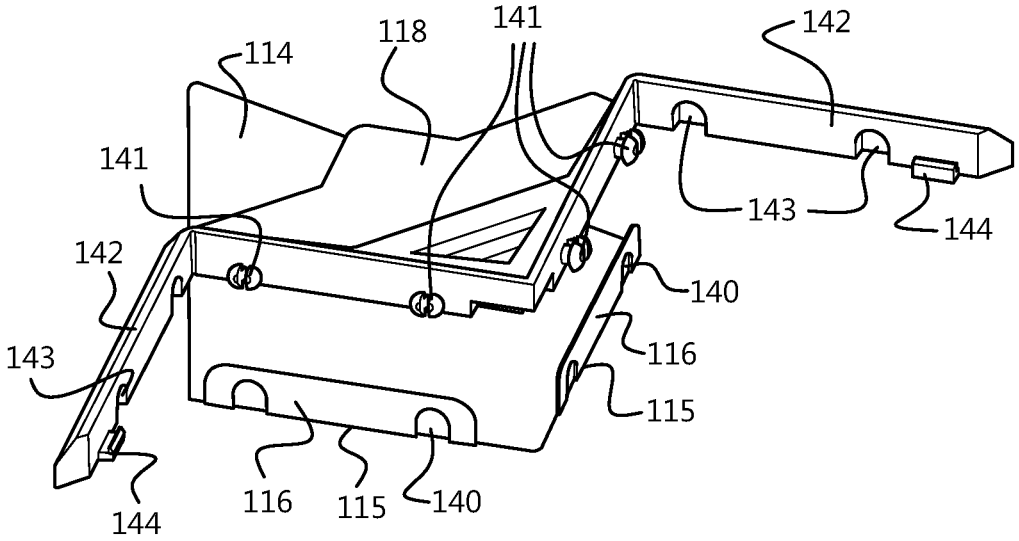
FIG. 5 shows an exploded view of a second attachment part and a connection member according to an embodiment.

FIG. 5 schematically shows an alternative shape of a second attachment part 118 and a connection member 114. Features that have already been described above with reference to the first embodiment may also be present in FIGS. 5-6, and will not all be discussed here again. For the discussion with reference to FIGS. 5-6, like features are designated with similar reference numerals preceded by 100, to distinguish the embodiments.

In FIG. 5, the connection member 114 comprises a folded part 116 perpendicular to the sheet 102. The folding line with the folded part 116 forms a connection region 115. An opening 140 in the folded part 116 accommodates a protrusion 141, which is itself covered by a cover member 142. In this way, the second attachment part 118 is well attached to the sheet 102.

The second attachment part 118 comprises two cover members 142 that are pivotably connected with the main part of the second attachment part 118, and can be folded over the protrusions 141 after the openings 140 in the folded parts 116 have been placed around the protrusions 141. The cover members 142 comprise cavities 143, which can partially accommodate the protrusions 141. The cover members 142 can then be fixed to the main part of the second attachment part 118 using fixing mechanisms 144.

Figure 6:
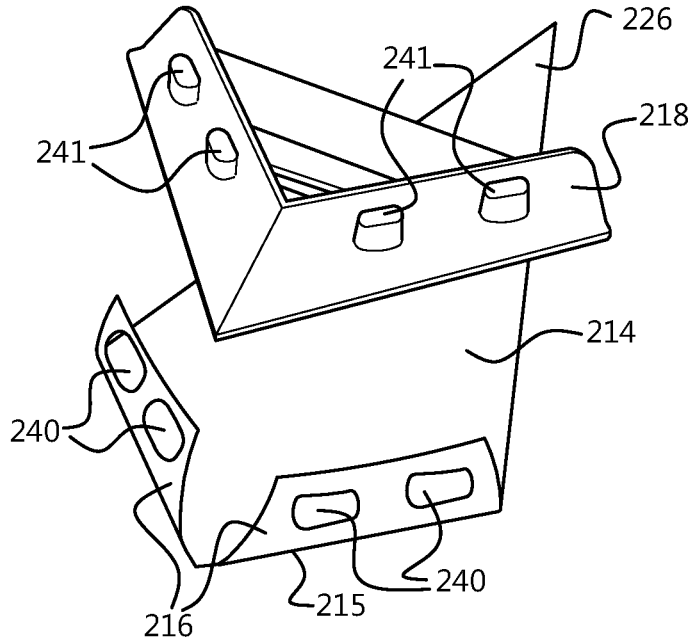
FIG. 6 shows an exploded view of a second attachment part and a connection member according to an alternative embodiment.

FIG. 6 shows a second attachment part 218 and a connection member 214. The second attachment part 218 comprises four protrusions 241, protruding in a direction perpendicular to the planar portion 226 of the connection member 214. The connection member 214 comprises four openings 240 in the folded parts 216, arranged such that they can each accommodate a protrusion 241 when the second attachment part 218 is placed against the connection regions 215. The connection member 214 is flexible, such that the openings 240 can be stretched to accommodate the protrusions 241, and will remain fixed afterwards.

Figure 7:
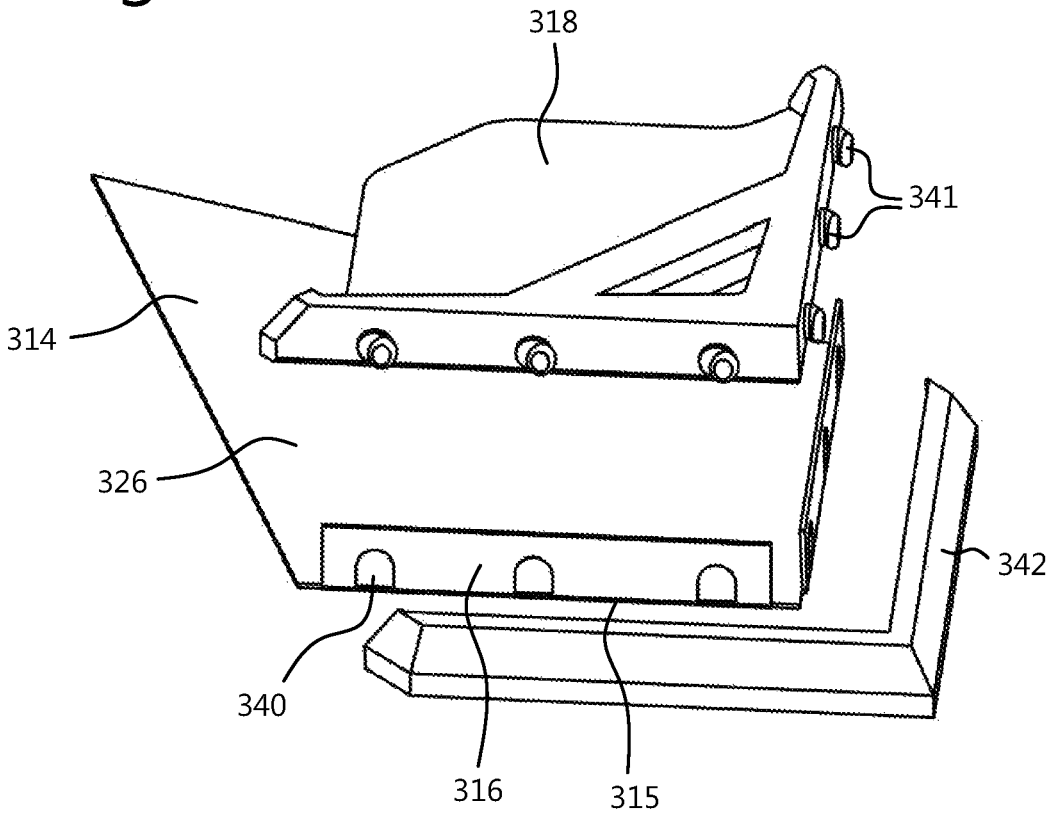
FIG. 7 shows an exploded view of a second attachment part and a connection member according to an alternative embodiment.

FIG. 7 shows an alternative embodiment of a second attachment part 318 and a connection member 314. The second attachment part 318 comprises six protrusions 341, protruding in a direction perpendicular to the planar portion 326 of the connection member 314. The connection member 314 comprises six openings 340 in the folded parts 316, arranged such that they can each accommodate a protrusion 341 when the second attachment part 318 is placed against the connection regions 315. The connection member 314 can be flexible, such that the openings 340 can be stretched to accommodate the protrusions 341, and will remain fixed afterwards. An L-shaped cover member 342 is firstly placed (e.g. glued) against the folded parts 316, and the second attachment part 318 is placed against the folded parts and the inner side of the cover member (with the protrusions 341 engaging through the openings 340) afterwards.

Figure 8:
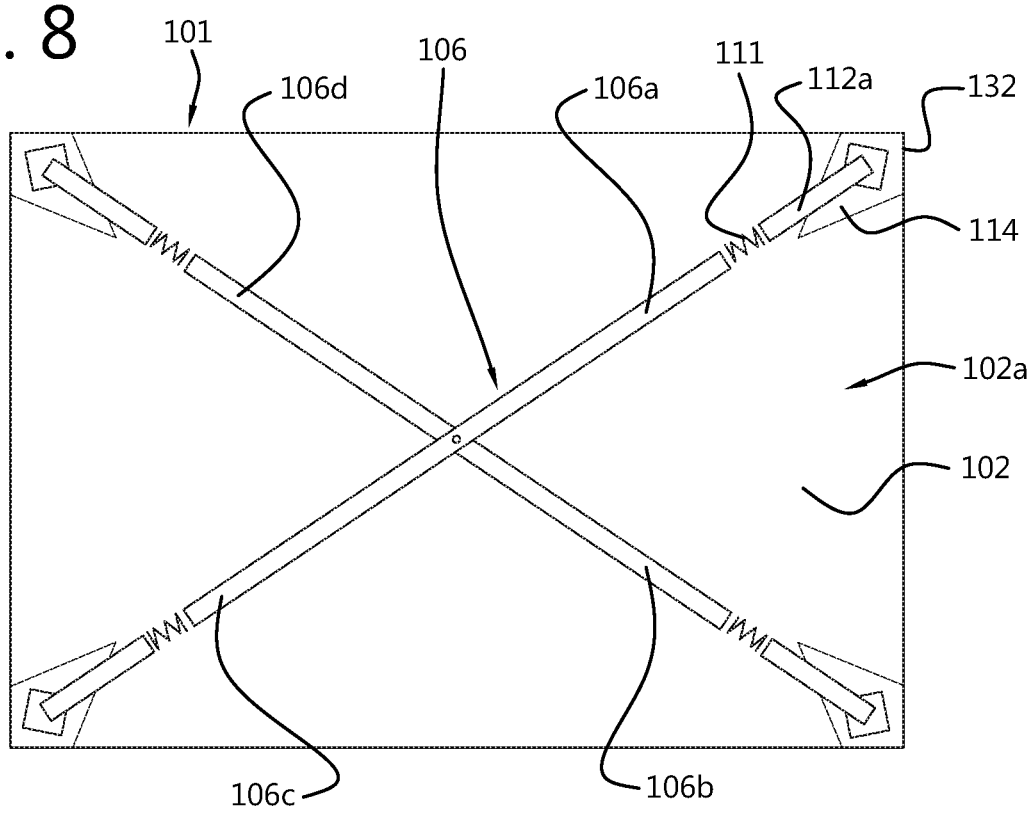
FIG. 8 shows a back side view of a mounting system with sheet according to an embodiment.

FIG. 8 shows a back side view of an embodiment of a mounting system 101 mounted at the back side 102*a* of a rectangular sheet 102. The mounting system 101 comprises an X-shaped mounting member 106, which consists of two rods that are pivotally connected in their centre. The four legs 106*a*, 106*b*, 106*c*, 106*d* of the X-shaped mounting member 106 extend all to a different corner 132 of the sheet 102. At each leg 106*a*, 106*b*, 106*c*, 106*d*, a corner segment 112*a* has been connected via a spring element 111, such that the corner segment 112*a* can resiliently translate in a direction defined by the longitudinal axis of the respective leg 106*a*. The corner segment 112*a* is attached to a flexible connection member 114, which is glued to the back 102*a* of the sheet 102 in the vicinity of a corner 132. In use, the spring elements 111 force the corner segments 112*a* apart in the plane defined by the sheet 102, such that a flat sheet 102 is ensured.

Figure 9:
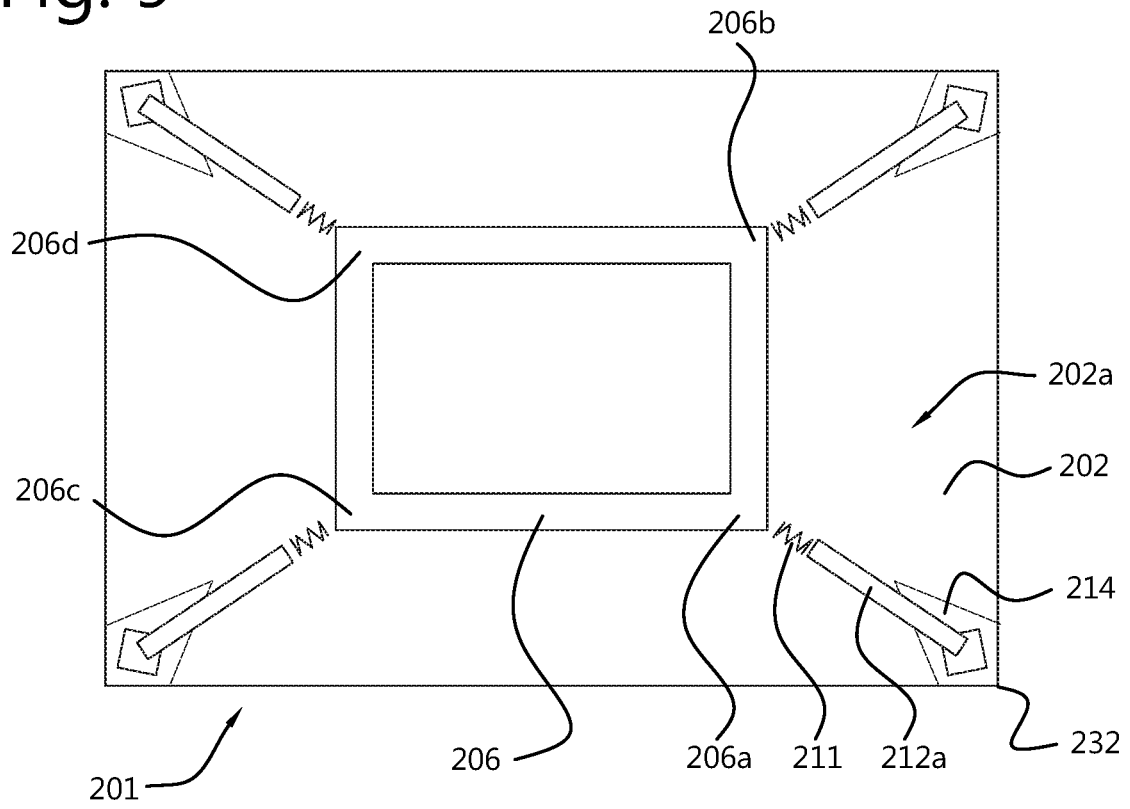
FIG. 9 shows a back side view of a mounting system with sheet according to an embodiment.

FIG. 9 shows a back side view of an embodiment of a mounting system 201 mounted at the back side 202*a* of a rectangular sheet 202. The mounting system 102 comprises a rectangular mounting member 206, which has a shape defined by the edges of a rectangle. At each corner 206*a*, 206*b*, 206*c*, 206*d* of the rectangular mounting member 206, a corner segment 212*a* has been connected via a spring element 211, and extends towards a corner 232 of the sheet 202. The corner segment 212*a* can thus resiliently translate with respect to the rectangular mounting member 206. The corner segment 212*a* and/or the spring element 211 may be pivotally connected to the rectangular mounting member 206, such that the mounting system 201 can adjust for the shape of the sheet 202. Only pivoting in the plane defined by the sheet 202 may be allowed. Each corner segment 212*a* is attached to a flexible connection member 214 which is glued to the back 202*a* of the sheet 202 in the vicinity of a corner 232. The spring elements 211 can force the corner segments 212*a* outward in the plane defined by the sheet 202, such that a flat sheet 202 is ensured.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. It will be apparent to the person skilled in the art that alternative and equivalent embodiments of the invention can be conceived and reduced to practice. All changes which come within the meaning and range of equivalency of the claims are to be embraced within their scope.

Reference numerals in the claims are not meant to be limiting for the scope. For conciseness, similar reference numerals corresponding to similar features of the described embodiments are referred to by their basic reference numerals (e.g. without the hundreds), wherever multiple embodiments are concerned. This does not suggest only referring to features corresponding with their basic numerals, i.e. (1) should be interpreted as (1; 101; 201) wherever this is relevant. Where correspondence is related to a specific embodiment, specific reference numerals with hundreds are used in the claims.

The invention claimed is:

1. A method for mounting a sheet delimited by edges substantially in a place, the method comprising:

providing a plurality of corner segments on the back of the sheet at least in a vicinity of corners between two edges;

interconnecting the corner segments by fitting at least one mounting member in between the corner segments;

providing a connection member, which is flexible and glued to the back of the sheet, part of the connection member forming at least one connection region that is configured to attach one of the corner segments to the connection member, the connection region comprising at least one attachment portion that is folded or foldable towards the corner segment and out of the plane;

attaching each of the plurality of corner segments to the at least one attachment portion that is folded out of the plane of a respective connection member; and subsequently forcing the corner segments apart in outward directions substantially along the plane, wherein at each corner, at least two of the connection regions are provided, which are each elongated and substantially aligned to one of the edges adjacent to the respective corner.

2. The method according to claim 1, wherein providing the plurality of corner segments comprises:

providing at least two engagement members, each comprising two adjacent corner segments of the plurality of corner segments and a main segment connecting the two adjacent corner segments and extending along a central part of an edge of the sheet, and wherein connecting the plurality of corner segments comprises:

fitting the at least one mounting member in between the engagement members.

3. The method according to claim 1, wherein each corner segment is attached to the connection member using at least one connection region.

4. The method according to claim 1, wherein the at least two connection regions at each corner are substantially perpendicular to each other.

5. The method according to claim 1, wherein the attachment portion comprises at least one opening which is adapted to be attached to the corner segment.

6. The method according to claim 5, wherein the method further comprises:

providing at least one cover member, wherein the cover member or the corner segment comprises at least one protrusion that is adapted to be accommodated inside an opening; and placing the at least one cover member over the openings, in order to attach the at least one attachment portion to the corner segment, wherein the at least one cover member is fixed to the corner segment, to maintain the at least one attachment portion in place and keep the at least one attachment portion attached to the cover member and the corner segment.

7. The method according to claim 6, wherein the corner segment or the cover member comprises at least one cavity, the cavity being adapted to at least partially accommodate the at least one protrusion therein.

8. A mounting system configured to mount a sheet delimited by edges substantially in one plane, wherein the plane is defined by the sheet, the system comprising:

a plurality of engagement members configured to be attached to the back of the sheet in the vicinity of corners between two edges of the sheet and at least one mounting member to be fitted between the engagement members, wherein each engagement member comprises:

at least one main segment extending along a central part of the respective edge, and at least two corner segments extending on either side of the main segment up to the corners, which are pivotable in the plane with respect to the main segment while their movability in a direction at right angles to the plane is limited, wherein each corner segment is connectable to a connection member which is flexible and adherable to the back of the sheet, the connection member including an attachment portion that is folded or foldable towards the corner segment and out of the plane when the connection member is adhered to the back of the sheet, and the corner segment being connectable to the connection member by attaching to the attachment portion when folded out of the plane, and wherein at each corner, at least two connection regions are provided which are each elongated and substantially aligned to one of the edges adjacent to the respective corner, and which are substantially perpendicular to each other.

9. The mounting system according to claim 8, wherein the at least one attachment portion comprises at least one opening, and the corner segment comprises at least one protrusion that is adapted to be accommodated inside the at least one opening.

10. The mounting system according to claim 8, further comprising at least one cover member placed against the attachment portion to maintain the attachment portion in place and keep the attachment portion attached to the corner segment.

11. The mounting system according to claim 10, wherein the at least one cover member comprises at least one cavity, wherein the at least one cavity is adapted to at least partially accommodate a protrusion therein.

12. The mounting system according to claim 8, wherein the at least attachment portion each comprise at least one opening, and wherein the mounting system further comprises at least one cover member, which comprises at least one protrusion, wherein the at least one protrusion is adapted to be accommodated inside an opening and the cover member is placed over the at least one attachment portion and attached to the corner segment, to maintain the at least one attachment portion in place and to attach the at least one attachment portion to the corner segment.

13. The mounting system according to claim 12, wherein the corner segment comprises at least one cavity, the cavity being adapted to at least partially accommodate a protrusion therein.

14. The mounting system according to claim 8, wherein each corner segment comprises:

a first attachment part which is connected to the main segment and a second attachment part, wherein the second attachment part is attachable to a connection member which is attachable to the back of the sheet, wherein the first attachment part is connectable to the second attachment part.

* * * * *